US007854035B2

(12) United States Patent
Gullicks et al.

(10) Patent No.: US 7,854,035 B2
(45) Date of Patent: Dec. 21, 2010

(54) DUAL-SIDED FLIP MOP

(75) Inventors: Scott D. Gullicks, Apple Valley, MN (US); David G. Sebesta, Woodbury, MN (US); Kevin L. McNulty, St. Paul, MN (US); Richard W. Wright, Lake Elmo, MN (US); John J. Dyer, Shoreview, MN (US); Thomas M. Apse, Maplewood, MN (US); Glendon D. Kappel, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1085 days.

(21) Appl. No.: 11/555,344

(22) Filed: Nov. 1, 2006

(65) Prior Publication Data

US 2007/0107153 A1 May 17, 2007

Related U.S. Application Data

(60) Provisional application No. 60/733,123, filed on Nov. 3, 2005.

(51) Int. Cl.
*A47L 13/20* (2006.01)

(52) U.S. Cl. ..... 15/147.1; 15/150; 15/231

(58) Field of Classification Search ..... 15/147.1, 15/150, 228, 231
See application file for complete search history.

(56) References Cited

U.S. PATENT DOCUMENTS 4,454,183 A * 6/1984 Wollman ..... 428/92
5,461,749 A * 10/1995 Ahlberg et al. ..... 15/228
5,864,914 A 2/1999 Salmon

FOREIGN PATENT DOCUMENTS

JP 09-038012 A 2/1997
KR 86-0003485 4/1986

* cited by examiner

*Primary Examiner*—Shay L Karls
(74) *Attorney, Agent, or Firm*—David B. Patchett

(57) ABSTRACT

The present invention features a cleaning implement, such as a mop, that may be used for cleaning a floor. The mop of the invention typically includes a mop head and a handle pivotally connected to the mop head. The mop head also includes means for securing a mop media, typically a flexible disposable cleaning sheet, to the mop head. The mop may be passed over the floor with one side of the cleaning sheet presented for cleaning the floor. The mop head may then be inverted with the other side of the cleaning sheet presented for further cleaning of the floor.

15 Claims, 10 Drawing Sheets

DUAL-SIDED FLIP MOP

CROSS REFERENCE TO RELATED APPLICATIONS

This application claims priority to U.S. Provisional Patent Application No. 60/733,123 filed on Nov. 3, 2005.

FIELD OF THE INVENTION

This invention relates generally to cleaning devices and more particularly to floor mops.

BACKGROUND

A variety of mops and other cleaning implements have been developed for cleaning and dusting floors and other surfaces. Many mops in common usage, such as string mops, have a cleaning surface that is repeatedly reused. In certain settings, such as hospitals and nursing homes, where there are concerns over hygiene and safety in dealing with hazardous chemical or biological wastes that may be spilled or otherwise present on floors, it is desirable to use a floor mop with a cleaning portion that is not reused, but instead is replaced between cleanings. With such mops, a disposable cleaning media, typically a flexible sheet of cleaning material, is secured to the mop head and removed after the cleaning operation is completed. The mop head is then reloaded with a fresh cleaning sheet prior to its next use.

SUMMARY OF THE INVENTION

Recognizing the desirability of a floor mop that is capable of being quickly and easily loaded with disposable mop media, and efficiently using such media, while minimizing the user's contact with contaminated cleaning material, the present invention provides a floor mop comprising (a) a mop head comprising a first cleaning support surface, a second cleaning support surface, and a leading edge, wherein the first and second cleaning support surfaces are angled relative to each other and diverge from each other as they extend away from the leading edge; (b) securing means for releasably attaching a portion of a flexible cleaning sheet to the mop head, and (c) a handle pivotally connected to the mop head to allow the mop head to be shifted between a first position in which the first cleaning support surface is presented to the floor and a second position in which the second cleaning support surface is presented to the floor.

In one embodiment of the invention, the securing means is located adjacent or proximate to the leading edge of the mop head. Suitable securing means include, but are not limited to, adhesives, hook and loop systems, clamping mechanisms, and the like. Typically, the securing means holds the flexible cleaning sheet to the front end of the mop head allowing the sheet to trail rewardly towards the back end of the mop head so that when a cleaning support surface of the mop head is presented to the floor, the cleaning sheet may be sandwiched between the floor and the cleaning support surface.

The cleaning support surfaces of the mop head are usually arranged in a generally v-shape configuration, with the cleaning support surfaces converging in the direction of the leading edge of the mop head. The angle formed between the planes of the cleaning support surfaces is generally between about 70 and about 5 degrees, typically between about 60 and about 10 degrees, more typically between about 45 and about 10 degrees, and most typically between about 30 and about 10 degrees.

In some implementations of the invention, the cleaning support surfaces may be connected together via a hinge that allows the mop to be toggled between an open position and a closed position. Accordingly, one aspect of the invention features floor mop comprising (a) a generally v-shaped mop head comprising a first head portion and a second head portion each having a front end, a back end, and a cleaning support surface, wherein the first and second head portions are hingedly connected to each other and may be shifted between an open position in which the front ends of the first and second head portion are separated so that a portion of a flexible cleaning sheet may be inserted between them and a closed position in which the front ends of the first and second head portion are held together so that a portion of the cleaning sheet may be secured to the mop head, and (b) a handle pivotally connected to the mop head to allow the mop head to be shifted between a first position in which the first cleaning support surface is presented to the floor and a second position in which the second cleaning support surface is presented to the floor.

The invention is not limited with respect to the type of mop media that may be attached or otherwise loaded onto the mop head. For example, the mop media may be in the form of a flexible cleaning sheet made of a non-woven fabric constructed of polymeric fibers, such as polypropylene, polyethylene, polyester, nylon, and rayon fibers. One particularly effective cleaning sheet is a blown microfiber web constructed of fibers comprising a blend of polypropylene and polyester. Other suitable cleaning sheets include natural fiber materials (cotton, linen, wool, etc.), woven or felted materials, and the like.

A variety of different hinges can be used to connect the cleaning support surfaces. Typically, the hinge is a living hinge that is resiliently biased towards the closed position. Other suitable hinges include, but are not limited to, any hinge that allows the two support surfaces to change the angle between them, such as, for example, a standard hinge, a piano hinge, a socket hinge, lift-off, latch, strap, pivot, and the like.

When the support surfaces of the mop head are attached via a hinge, it may be desirable in some implementations to include a locking mechanism for holding the mop head in either the open or closed position. Depending on the type of hinge employed, the mop head may naturally tend towards an open or closed position, or may not be biased toward either configuration. For embodiments that tend toward a closed position, it may be desirable to include a locking mechanism to hold the mop head open during loading of the cleaning sheet. Conversely, for embodiments that are biased towards an open position, and for unbiased hinges, it may be desirable to include a locking mechanism to hold the mop head closed during use.

In certain implementations, the front ends of the mop head are tapered so that, when the mop head is in the open position, a cleaning sheet may be smoothly and easily inserted between the first and second mop head portions. Typically, the taper expands rearwardly from the leading edge, and comprises a side that is coplanar with the cleaning support surface.

Alternatively, or additionally, the front ends of the mop head may comprise one or more features for gripping the cleaning sheet. Exemplary gripping features include a projecting ridge, a tine, a projecting tooth, an adhesive, a conformable pad, a hook and loop system, and an interlocking ridge and groove. In one embodiment, the gripping feature comprises a plurality of tines or projecting teeth, which are typically arranged in a staggered configuration.

To further assist in holding the cleaning sheet against the cleaning support surface, the mop head may also comprise one or more ridges protruding from the cleaning support surface to allow for easier back and forth movement. In one embodiment of the invention, at least one ridge protrudes from the back end of the cleaning support surface adjacent to the trailing edge. In addition, the back ends of the first and second head portions may optionally comprise a securing means for holding the trailing end of the flexible cleaning sheet to the mop head.

The above summary is not intended to describe each embodiment or every implementation of the invention. Other embodiments, features, and advantages of the present invention will be apparent from the following detailed description thereof, from the drawings, and from the claims.

BRIEF DESCRIPTION OF THE DRAWINGS

The invention may be more completely understood in consideration of the following detailed description of various embodiments of the invention in connection with the accompanying drawings, which are described below.

DEFINITIONS

Figure 1A:
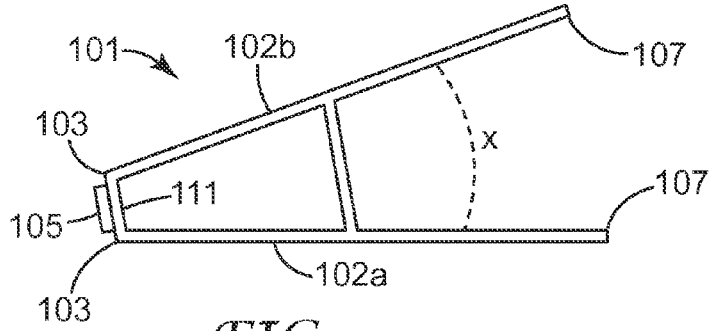
FIG. 1*a* is a side view of a mop head according to the invention.

As used herein, the term "leading edge" refers the edge or edges of the mop head or cleaning support surface that is/are in the front-most position when the cleaning support surface is presented to the floor and the mop is moved forward along the floor ahead of the user.

By "trailing edge" is meant the edge or edges of the mop head that is/are in the rear-most position when a cleaning support surface is presented to the floor and moved forward ahead of the user.

By "front end" the portion of the mop head that is proximate or adjacent the leading edge.

By "back end" the portion of the mop head that is proximate or adjacent the trailing edge.

By "living hinge" is meant a flexible web or strip of material that joins two rigid bodies (e.g. cleaning support surfaces) together and allows movement of the two bodies through flexural bending of the web or strip material. Most commonly the web or strip material is of the same type as the two rigid bodies.

As used in this specification and the appended claims, the recitation of numerical ranges by endpoints includes all numbers subsumed within that range (e.g. 1 to 5 includes 1, 1.5, 2, 2.75, 3, 3.80, 4, and 5). In addition, the use of singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Unless otherwise indicated, all numbers expressing quantities of ingredients, measurement of properties such as contrast ratio and so forth used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviations found in their respective testing measurements.

DETAILED DESCRIPTION

The present invention features a cleaning implement, such as a mop, that may be used for cleaning a floor. The mop of the invention typically includes a mop head and a handle pivotally connected to the mop head. The mop head also includes means for securing a mop media, typically a flexible disposable cleaning sheet, to the mop head. The mop may be passed over the floor with one side of the cleaning sheet presented for cleaning the floor. The mop head may then be inverted with the other side of the cleaning sheet presented for further cleaning of the floor.

Figure 1B:
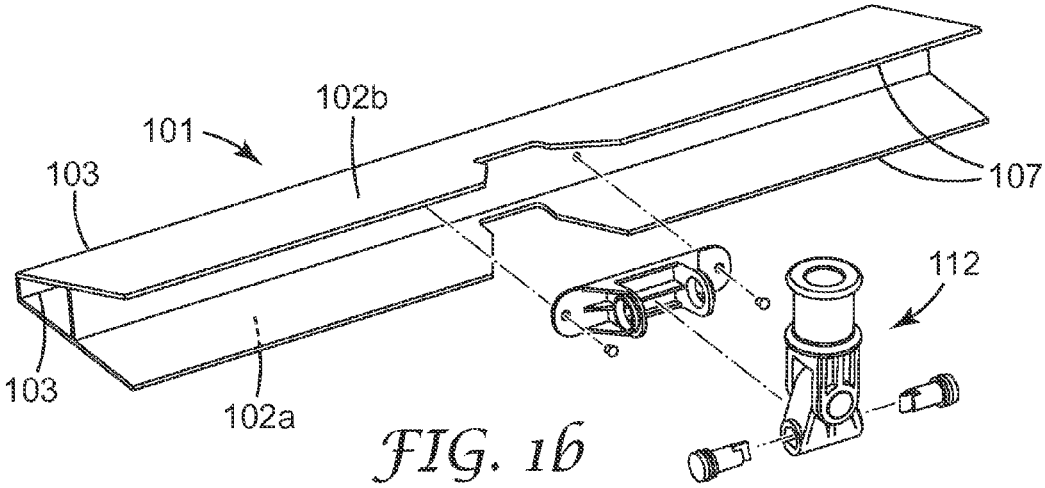
FIG. 1*b* is a perspective view of the mop head of FIG. 1 showing a pivot assembly.
Figure 1C:
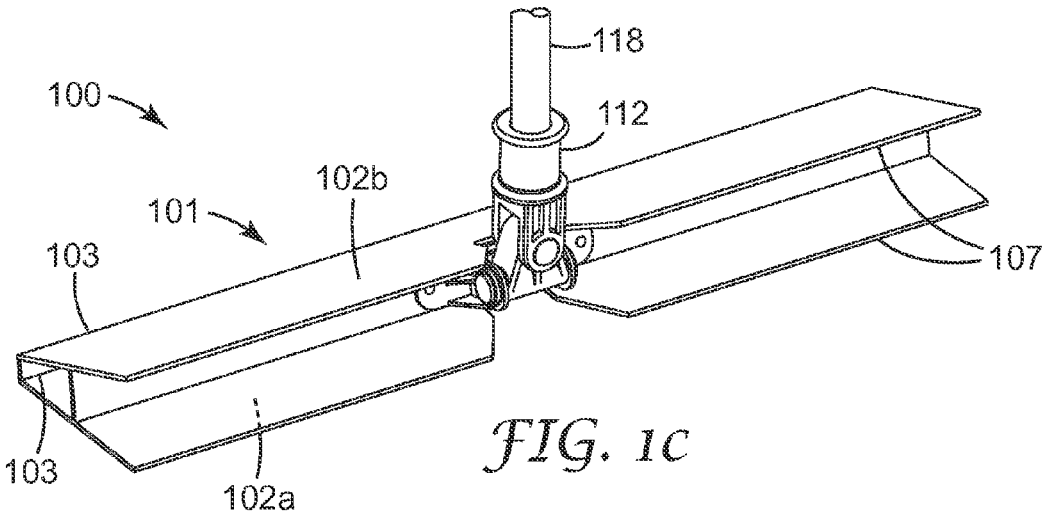
FIG. 1*c* is a perspective view of the mop head of FIGS. 1*a* and 1*b* with a handle attached via the pivot assembly.

One embodiment of the mop according to the invention is shown in FIG. 1*a-c*. The mop 100 includes a mop head 101, a first cleaning support surface 102*a*, and a second cleaning support surface 102*b*, which are angled relative to each other so that they converge in the direction of the longitudinal leading edge(s) 103, and diverge as they extend rearward toward the longitudinal trailing edge(s) 107 of the mop head, thereby forming a general v-shape. As used herein, "v-shape" includes a truncated v-shape. The mop head further includes a connection member 112 to allow for the mop head to be pivotally connected to a handle 118.

The angle x formed between the planes of the first and second cleaning support surfaces is typically between about 70 and about 5 degrees, more typically between about 60 and about 10 degrees, most typically between about 45 and about 10 degrees.

The mop head further includes a means to secure a portion of a flexible cleaning sheet or other mop media to the mop head. As depicted in FIG. 1*a*, the securing means 105 may be located at the front end 111 of the mop head at or near the leading edge(s). The securing means 105 may be any element or feature for attaching mop media to the mop head 101. For example, the securing means may be an adhesive, a component of a hook and loop system (or similar pair of cooperative segments), VELCRO, a clamping mechanism, and the like. In one embodiment, the securing means may be constructed with a plurality of projections, such as the "hook" portion of a hook and loop mechanical fastener system. The hooks or projections are used to engage and retain the cleaning sheet on the mop head. Such hooks are described in U.S. Pat. No. 4,454,183, entitled "Strip Material With Heat Formed Hooked Heads".

Figure 2A:
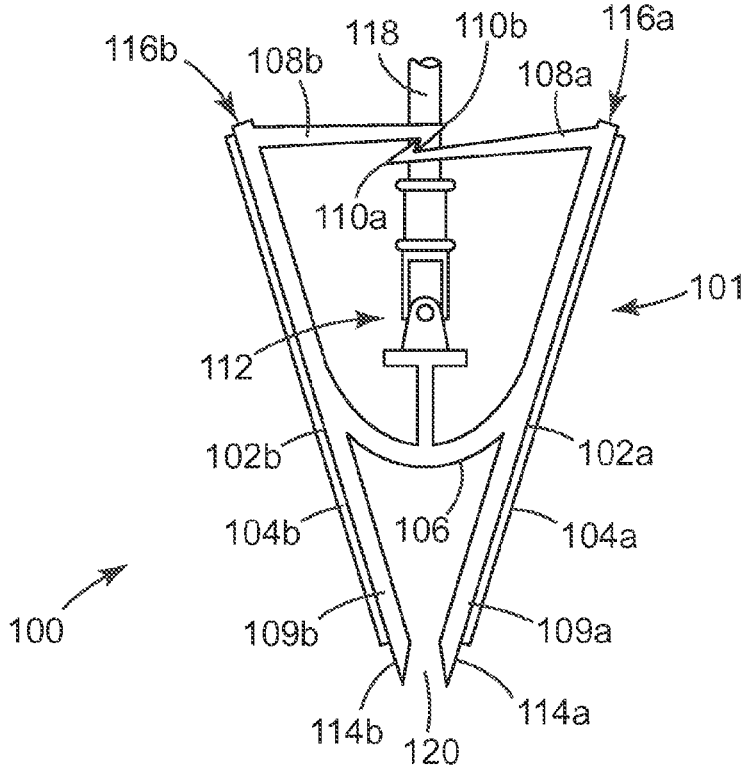
FIG. 2*a* is a side view of a mop according to the invention with the mop head in the open position.
Figure 2B:
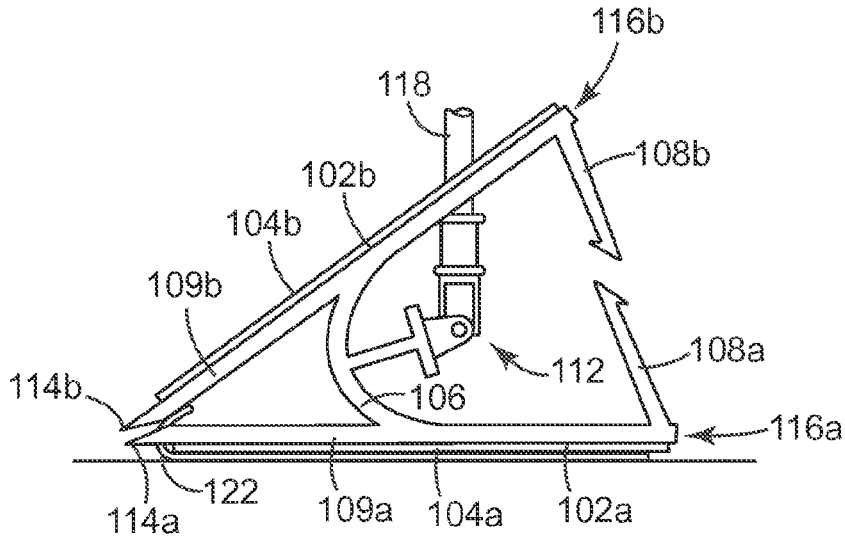
FIG. 2*b* is a side view of the mop of FIG. 2*b* shown in the closed position with a cleaning support surface presented to the floor.

Turning now to FIGS. 2*a* and 2*b*, there is shown another variation of the mop 100. In this embodiment, the mop head 101 includes a first head portion 109*a*, which includes a front end 114*a*, a back end 116*a*, and a cleaning support surface 102*a*. The mop head also includes a second head portion 109*b*, which likewise includes a front end 114*b*, a back end 116*b*, and a cleaning support surface 102*b*.

In some implementations of the invention, the first mop head portion 109*a* and the second mop head portion 109*b* are shiftable with respect to each other, allowing the mop head 101 to be toggled between an open position (as depicted, for example, in FIG. 2*a*) and a closed position (as depicted, for example, in FIG. 2*b*). In the open position, the front ends 114*a* and 114*b* of two head portions 109*a* and 109*b*, respectively, are spaced apart or otherwise separated from each other thus forming a gap 120 between the leading edges of the mop head. In the closed position, the front ends 114*a* and 114*b* are held together, adjacent each other, thereby acting as a clamping element for securing mop media, for example, a flexible cleaning sheet 122, to the mop head. When in the open position, a portion of a flexible cleaning sheet 122, or similar mop media, may be inserted in between the cleaning support surfaces 102*a*, 102*b* so that when the mop head portions 109*a*, 109*b* are shifted to their closed position, the cleaning sheet is engaged with the mop head, as shown in FIG. 2*b*.

Figure 5:
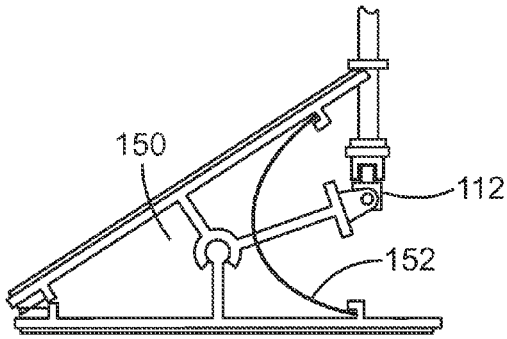
FIG. 5 is a side view of a mop according to the invention.

Any suitable mechanism may be employed to toggle the mop head between the open and closed positions. In one embodiment of the invention, the first mop head portion 109*a* and the second mop head portion 109*b* are connected by a hinge element 106, which is used to transition the head portions between the open and closed positions. The hinge may be unbiased, favoring neither the open nor closed position, or it may be biased toward either configuration. In one embodiment, the hinge is a living hinge, which applies a force to the mop head portions 109*a*, 109*b* that tends to bring them together in a clamping action, thus holding the mop head in a closed position. As shown in FIG. 5, the hinge can be a bendable strip of metal or plastic inserted into the interior region 150 of the mop head in between the cleaning support surfaces. Other suitable types of hinges include, but are not limited to, any hinge that allows the two support surfaces to change the angle between them, such as, for example, a standard hinge, a piano hinge, a socket hinge, lift-off, latch, strap, pivot, and the like.

Figure 3A:
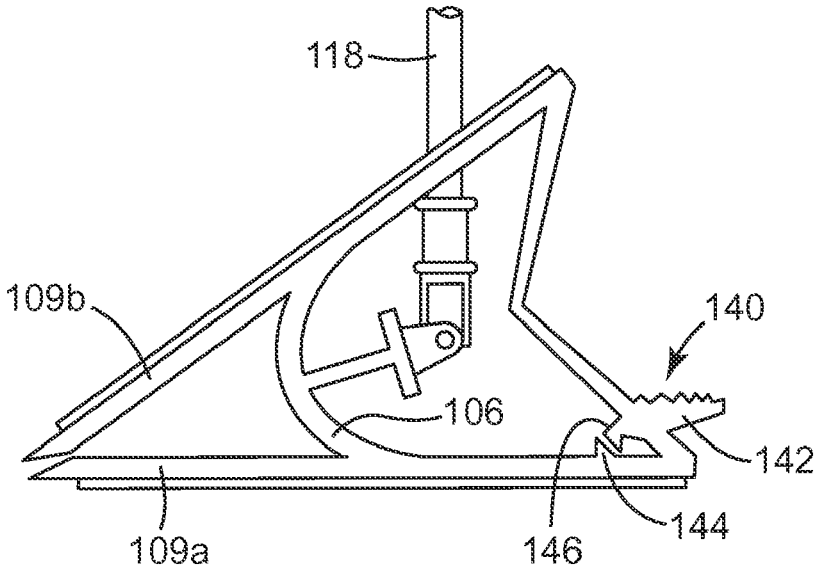
FIG. 3*a* is a side view of a mop according to the invention with the mop head in the closed position and a cleaning support surface presented to the floor.
Figure 3B:
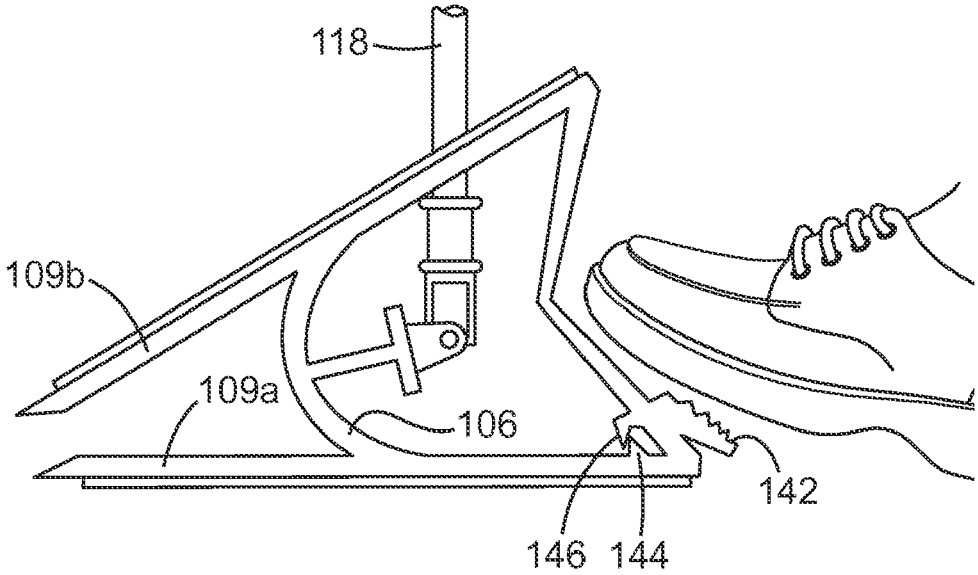
FIG. 3*b* is a side view of the mop of FIG. 3*a* shown in the open position.

The mop head 101 may further including a locking mechanism for holding it in either the open or closed position. For embodiments that have a hinge biased towards a closed position, the locking device operates by preventing the hinge from bringing the front ends of the first and second mop portions into contact, thereby holding the device in the open position. Such locking mechanisms can take a variety of forms. For example, FIGS. 2*a* and 2*b* show a locking mechanism that comprises a pair of tooth-like prongs 108*a*, 108*b* projecting inwardly from the back ends 116*a*, 116*b*. The hinge 106, is a living hinge that connects the mop head portions 109*a*, 109*b* and biases the head towards a closed position by applying force that brings the front ends 114*a*, 114*b* of the head portions together in a clamping action. The prongs 108*a*, 108*b* of the locking mechanism have interlocking notches or hooks 100*a*, 100*b*. The user applies an inward force to the cleaning support surface at or near (adjacent) one or both of the back ends 116*a*, 116*b* of the mop head 101 thereby bending the hinge 106 and forcing the mop head 101 into an open position. The notches 100*a*, 100*b* are adapted to engage each other, thereby holding the mop head 109 in the open position against the force of the hinge 106. The mop head 101 is returned to the closed position by disengaging the notches and allowing the force exerted by the hinge 106 to shift the mop head 101 back into the closed position (i.e. bring the front ends 114*a*, 114*b* into contact). As shown in FIG. 3*a* and b, the locking mechanism 140 may be in the form of a pedal 142, which when depressed by application of a downward force causes the complimentary projections 144 and 146 to engage, thereby holding the mop head in the open position.

Figure 6A:
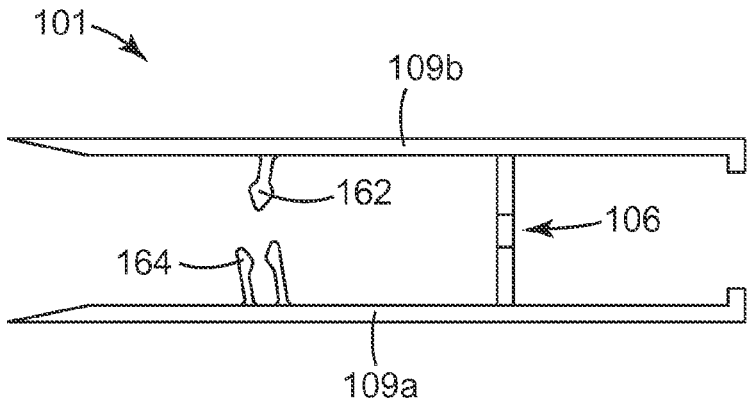
FIG. 6*a* is a side view of a mop head according to the invention with a living hinge shown in the open position.
Figure 6B:
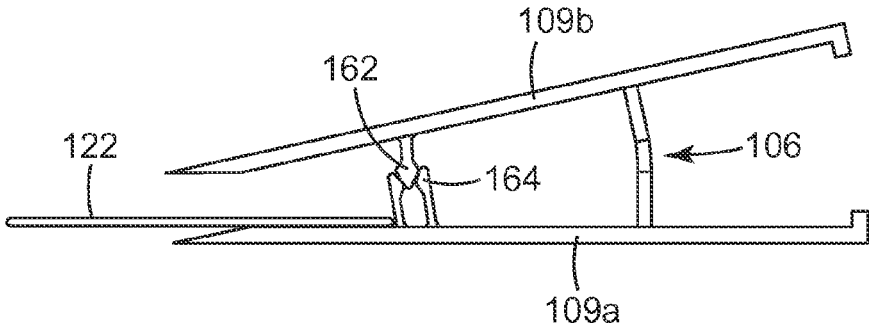
FIG. 6*b* is a side view of a mop head shown in FIG. 6*a* with a portion of a flexible cleaning sheet loaded therein
Figure 6C:
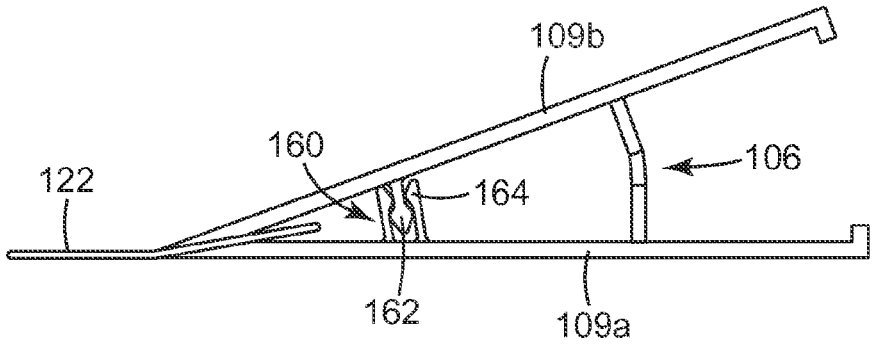
FIG. 6*c* is a side view of the mop head shown in FIG. 6*a* shown in the closed position

In yet another embodiment, shown in FIG. 6*a*, 6*b*, and 6*c*, the locking mechanism 160 comprises a pair of complimentary projections 162, 164 that extend inwardly from the first and second mop head portions 109*a*, 109*b* and are located between the hinge 106. The projections 162, 164 have complimentary shapes that are designed to snap together. The projections provide resistance which must be overcome in order to force the mop head 101 to shift into either the open or closed position. An advantage of this arrangement is that the complimentary projections 162, 164 provide a positive means to lock the mop head 101 in the closed position in order to clamp and retain the cleaning sheet 122. Additionally, when the user clamps the mop head 101 into the closed position, the interface of the latching features provides audible feedback to the user as it 'snaps' into place. The same features provide a means to retain the mop head 101 in the open position to allow for easy loading and unloading of the cleaning substrate. When in the open, or loading position, the projecting features 162, 164 of the latching feature 160 acts as a registration 'stop' to aid the user in proper positioning and aligning of the cleaning substrate 122.

In certain implementations, such as those shown FIGS. 2*a*, 2*b*, 4*a* and 4*b*, the mop head has a generally v-shape in both the open and closed positions. In other implementations, such as that shown in FIGS. 6*a*, 6*b*, and 6*c*, the mop head assumes a generally v-shape when in the closed position, i.e. the position in which it is adapted to perform the cleaning operation, but is not necessarily v-shaped when in the open position. Whether or not the mop head retains a v-shape in the open position generally depends on how far the front ends are moved apart.

Having a generally v-shaped mop head enables the mop to better trap and retain debris in front of the user so that it may be pushed along the floor and collected. The incline of the mop head is typically sufficient so that the majority of debris is collected without passing over the top of the mop head.

Disposable mop media, typically in the form of a flexible clean sheet can be attached to the mop head by inserting a portion thereof into the gap 120 (shown in FIG. 2*a*) between the front ends 114*a*, 114*b* of the mop head while it is in the open position. During use, the remaining portion of the cleaning sheet is positioned between cleaning support surface and the floor in order to clean the floor through sliding contact therewith. The cleaning sheet 122 may be formed from any suitable flexible material adapted to collect the substance that is to be cleaned from a surface. The cleaning material may be woven, non-woven, or have a sponge-like structure, or any other suitable arrangement. For instance, a non-woven fabric may be employed that is constructed from processes such as by spunbonding or by fibrillation.

In most applications, it is anticipated that the cleaning sheet will be adapted to collect particulate matter, such as dust, from a floor or other like surface to be cleaned and retain most particulate matter on or in the sheet member. In this embodiment, the floor mop is more particularly referred to as a dust mop. It is also possible to select a material to construct the cleaning sheet of a material that absorbs liquid materials. For instance, it is possible to select a material that is hydrophobic or hydrophilic. Similarly, it is possible to select a material to construct the cleaning sheet that is selectively oleophobic or oleophilic. The following is a non-exclusive list of materials that may be used to construct the cleaning sheet: cellulosic fibrous web, polypropylene, polyethylene, and rayon webs, cotton, linen, wool and the like.

A particularly useful cleaning sheet can be constructed of an embossed web, between 1-30 mm in thickness, constructed of non-woven, random discontinuous blown microfibers and crimped macrofibers of polymeric materials according to U.S. Pat. No. 4,118,531, entitled "Web of Blended Microfibers and Crimped Bulking Fibers," the contents of which are incorporated herein by reference. In one embodiment, the fibers comprise a 60/40 blend of polypropylene/polyester. Such material is available from the Minnesota Mining and Manufacturing Company ("3M") of St. Paul, Minn. under the trademark DOODLEDUSTER cloth.

Typically, the cleaning sheet is rectangular in shape, has two opposing cleaning surfaces, and includes a longitudinally extending attachment edge and a parallel trailing edge. A plurality of the cleaning sheets may be conveniently provided individually, stacked, or fan folded, most conveniently, the cleaning sheet is providing as part of a continuous strip in roll form. The cleaning sheet material may be severed from the free end of the roll in desired lengths, such as with a knife or scissors. However, the roll may be constructed with a plurality of transverse weakened lines at selected spaced locations. Although the weakened line may be formed, for example, by scoring the cleaning sheet material, typically the weakened line takes the form of a perforated line. The weakened lines enable a segment of the cleaning sheet material to be manually separated from the roll. The weakened lines may be located at desired regular intervals so that a single segment, or multiple segments may be separated as a unit so that a single roll may be provided to supply cleaning sheet material to a variety of floor mops of different sizes. Although it may be possible to clean the cleaning sheet and reuse it, more typically the cleaning sheet is discarded after use and replaced with a fresh, unused cleaning sheet.

Figure 4A:
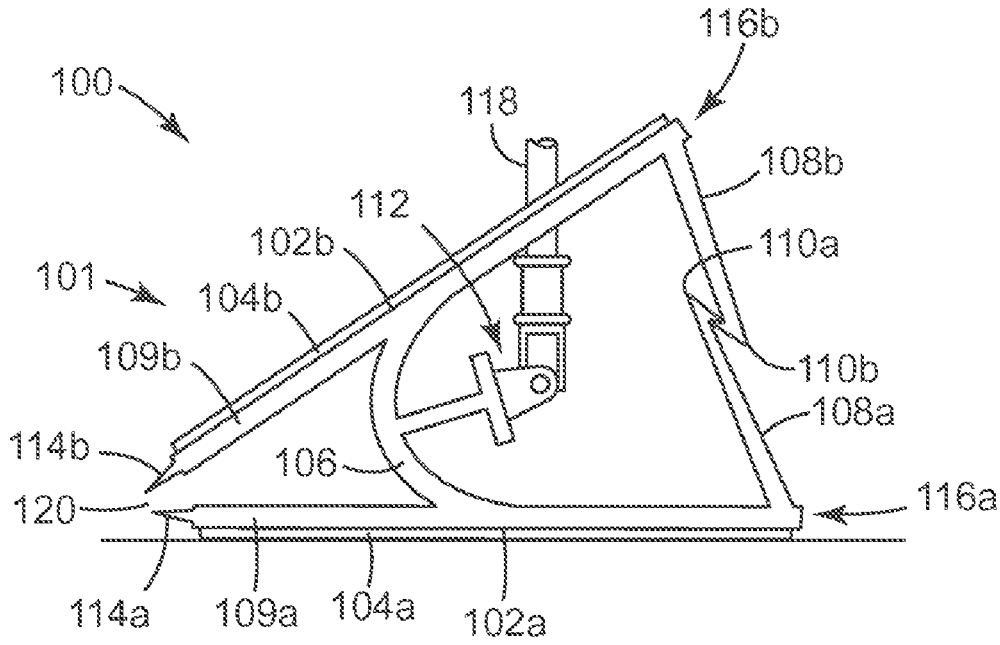
FIG. 4*a* is a side view of a mop according to the invention with the mop head in the open position and a cleaning support surface presented to the floor.
Figure 4B:
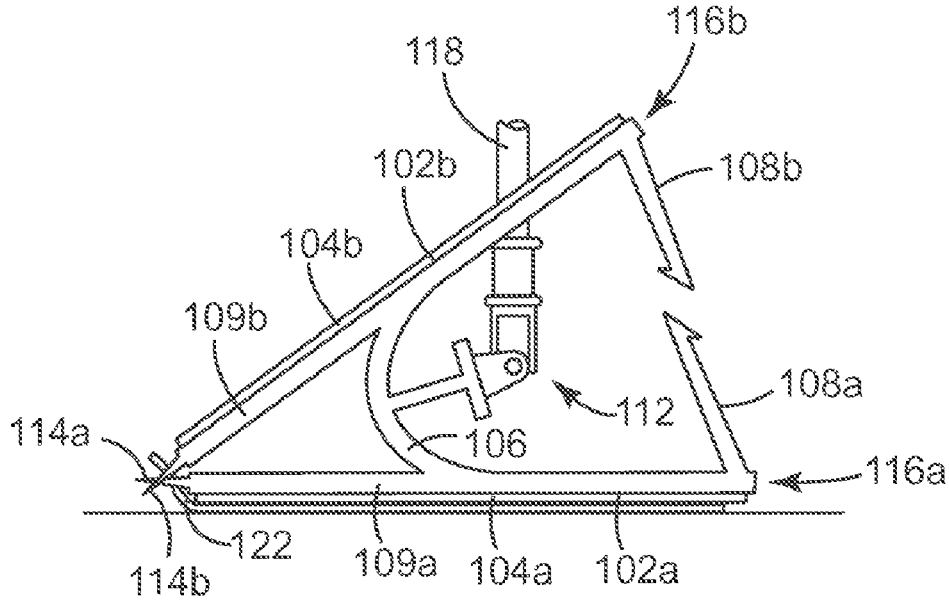
FIG. 4*b* is a side view of the mop of FIG. 4*a* shown in the closed position with a flexible cleaning sheet secured to the leading edge of the mop head.

As shown in FIGS. 4*a* and 4*b*, a portion of the flexible cleaning sheet 122 is held in between the front ends 114*a*, 114*b* of the mop head portions 109*a*, 109*b*, thereby attaching the sheet to the mop head. Means are provided to clamp or fasten the front ends 114*a*, 114*b* of the first mop head portion 109*a* and the second mop head portion 109*b* together when they are in their closed position to secure the cleaning sheet 122 in engagement with the mop head. Any suitable clamping arrangement may be employed. Typically this is done by using a hinge 106 that resiliently biases the first mop head portion and the second mop head portion in their closed position (thus providing a clamping action), and/or a mechanical snap closure (shown as 160 in FIG. 6*c*), or hook and loop type mechanical fasteners as have previously been discussed herein.

The front ends 114*a*, 114*b* of the first and second mop head portions may be so constructed as to facilitate the securement of the cleaning sheet to the mop head when the first and second mop head portions 109*a*, 109*b* are in their closed position. For example, as shown in FIGS. 4*a* and 4*b*, the front ends 114*a*, 114*b* may comprise one or more projecting prongs or tines for engaging the cleaning sheet 122, which is secured by shifting the first and second mop head portions 109*a*, 109*b* to their closed position. The prongs or tines may be staggered or non-staggered.

Figure 4C:
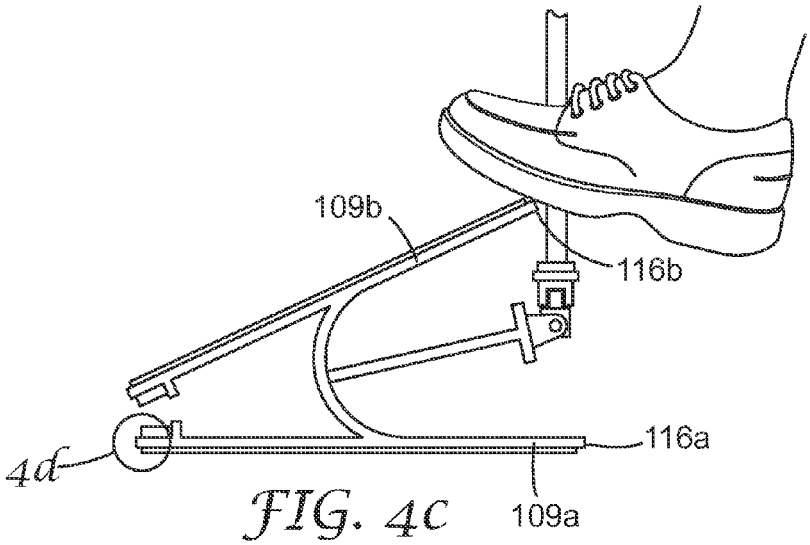
FIG. 4*c* is a side view of a mop according to the invention with the mop head being held in the open position by the user applying force to the back end.
Figure 4D:
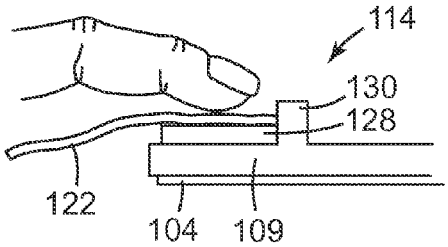
FIG. 4*d* is an expanded view of the front end of the mop head of FIG. 4*c* showing a portion of the securing means for releasable attachment of a flexible cleaning sheet to the leading edge of the mop head.
Figure 4E:
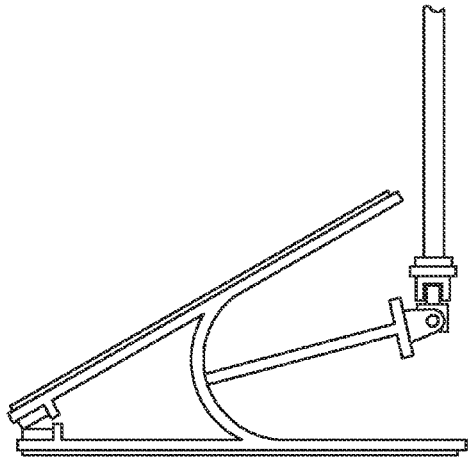
FIG. 4*e* is a side view of the mop of FIG. 4*c* shown in the closed position with a cleaning support surface presented to the floor.

Other features that may be provided on the front ends for gripping the cleaning sheet include, but are not limited to an adhesive, a conformable pad (as shown in FIGS. 4*c*, 4*d* and 4*e*), a component of a hook and loop system, and an interlocking ridge and groove.

Figure 8A:
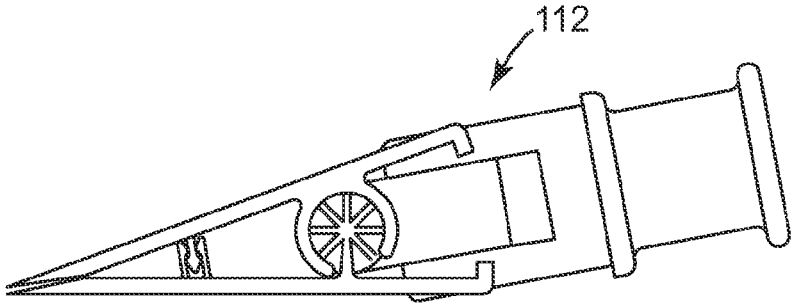
FIG. 8*a* is a side view of a mop head according to the invention with a rotating pivot hinge.
Figure 8B:
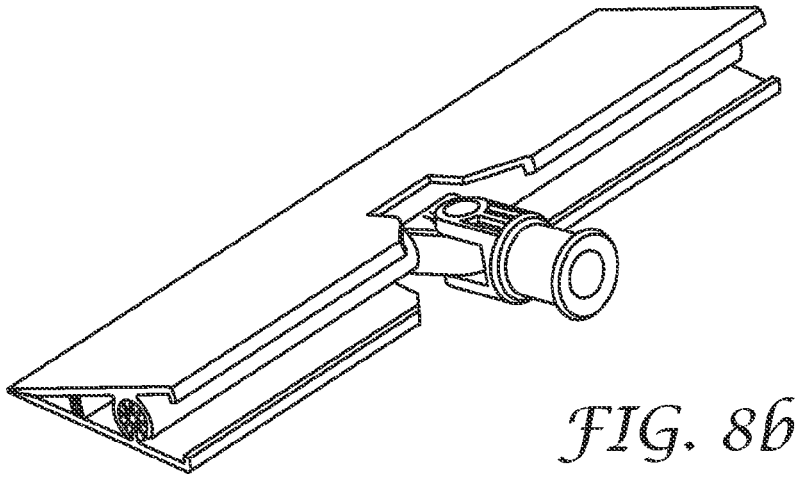
FIG. 8*b* is a perspective view of the mop head of FIG. 8*a*.

The handle member 118 is adapted for manual engagement. One end of the handle member 118 is connected to the mop head 101. Any suitable arrangement may be provided to connect the handle member to the mop head. Typically, the handle member is pivotally connected to the mop head, to facilitate the manipulation of the mop head as hereinafter described. In one embodiment, the handle member is pivotally connected to the mop head by a positional universal joint, such as is shown and described in U.S. Pat. No. 3,850,533, the contents of which are incorporated herein by reference. An operator may place the handle and frame in a pre-selected position to effectively clean a given surface, and when he desires, readily manually reposition the frame and handle without loosening or tightening screws, bolts, or other type of fastener. Preferably, the handle 118 is connected to the mop head 101 with a swivel connector having two degrees of freedom, such as that used in the DOODLEDUSTER dusting system, available from 3M Company, St. Paul, Minn., and shown in FIG. 1 and FIGS. 2A and 2B of U.S. Pat. No. 5,461,749, which is incorporated herein by reference. Alternatively, the handle may be attached to the mop head with a rotating pivot of the connector type show FIGS. 8*a* and *b*.

Although the handle may be connected to the mop head at any suitable location, typically, it is centered at the longitudinal midpoint of the mop head; and midway between the first cleaning support 102*a* surface and the second cleaning support surface 102*b* as shown in FIG. 2*a*. It is believed that this location most effectively facilitates the manipulation of the mop head and most efficiently applies the force applied to the mop head form the handle member to urge the cleaning sheet into contact with the surface to be cleaned.

The illustrated embodiments facilitate the construction of the first mop head portion and the second mop head portion to be molded in unitary manner, typically from a polymeric material. The following is a non-exclusive list of the polymeric materials from which the first and second mop head portions may be molded: urethane, acrylonitrile butadiene styrene (ABS), polypropylene, polyvinyl chloride (PVC), and nylon. The mop head is made through an extrusion die where the melted PVC is forced through a die cut to the desired shape. In any case, the components of the floor mop, including the mop head and the cleaning sheet, should be constructed from materials that are resistant to the environment and substances to which the floor mop is exposed during use.

A preferred material for the mop head is PVC, and the swivel mounting bracket is preferably either HIPS (High impact polystyrene) or ABS. The mop head is constructed using an extrusion die through a conventional extrusion processes, where melted PVC is forced through a die cut to the desired shape. The swivel mounting bracket is typically injection molded, and the swivel is attached to the bracket by lining up the axis of mating holes and inserting fastening pins. The bracket assembly is typically attached to the mop head with rivets. A mop handle can then be screwed into the mop assembly.

Figure 9A:
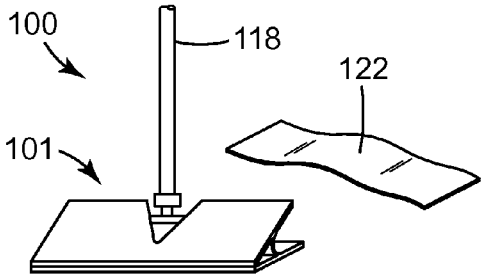
FIGS. 9*a, b, c, d, e, f, g, h, i* and *j* are diagrams showing typical steps in loading and using a mop according to the invention.
Figure 9B:
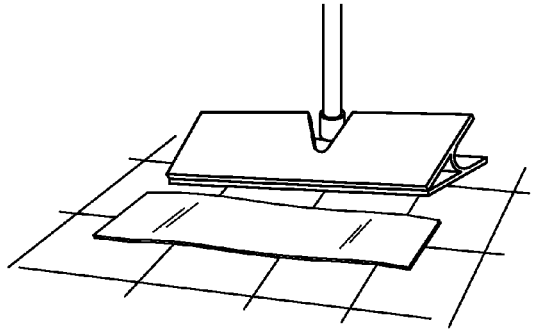
Figure 9C:
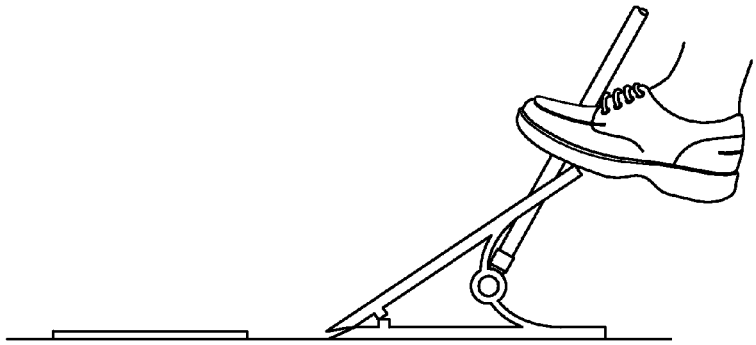
Figure 9D:
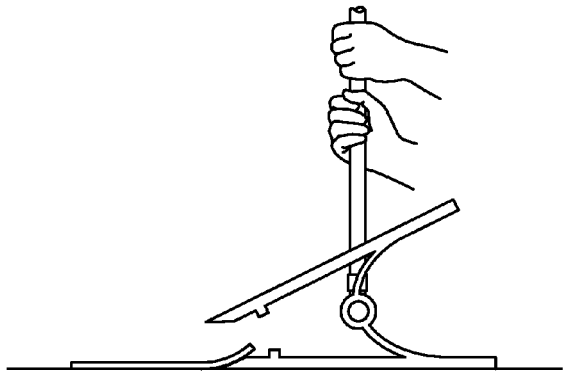
Figure 9E:
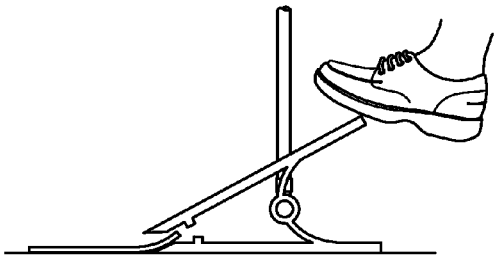
Figure 9F:
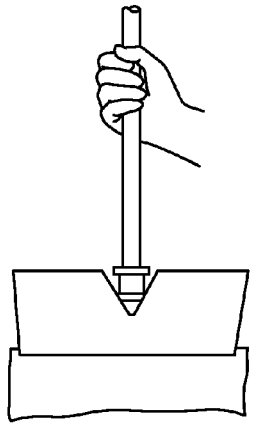
Figure 9G:
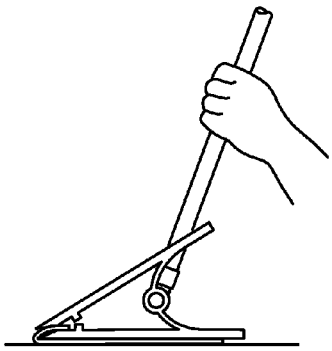
Figure 9H:
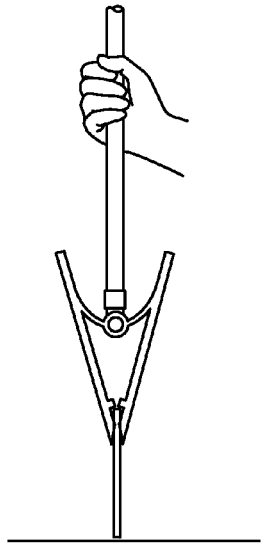
Figure 9I:
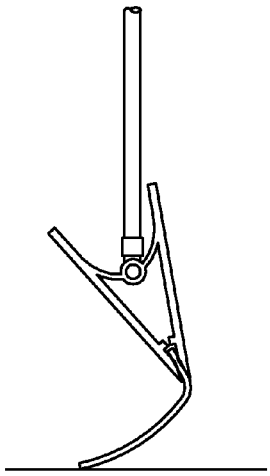
Figure 9J:
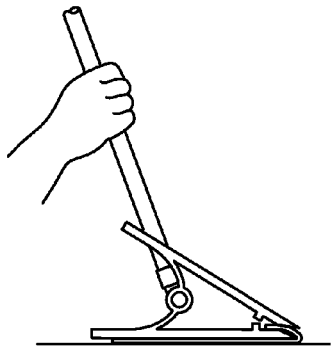
Figure 10:
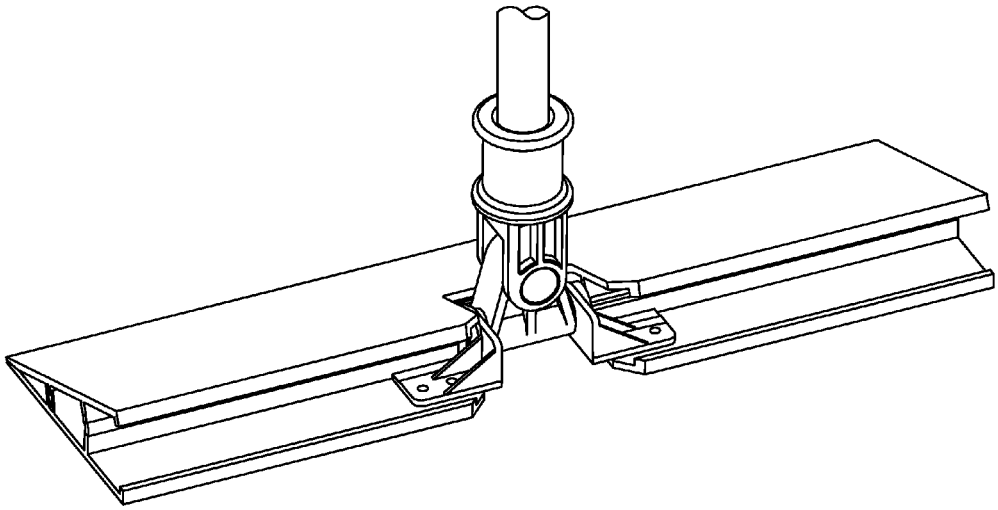
FIG. 10 is a perspective view of the mop head of FIG. 6*a* with a handle attached via pivot assembly. While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

Typical operation of the mop 100 is shown in FIG. 9*a-j*. The mop head 101 is manipulated by the handle member 118 so as to present a cleaning support surface to the floor. A cleaning sheet 122 may then be attached to the mop head 101 by positioning the sheet in front of the mop head as shown in FIG. 9*b*. A downward force is applied at or proximate to the back end of the mop head, for example by the user stepping on the back end of the mop head (shown in FIG. 9*c*) or pushing down on the handle (shown in FIG. 9*d*), thereby causing the front ends of the first and second head portions to move apart. One edge of the cleaning sheet is inserted between the first and second mop head portions, as is shown in FIG. 9*d*, and the mop head is shifted back to the closed position thereby clamping the cleaning sheet to secure it to the mop head. It is one of the features of the present invention that only one edge of the cleaning sheet is required to be secured to the mop head. This enables a relatively narrow cleaning sheet to be utilized system. It also allows from both side of the cleaning sheet to be utilized. Specifically, after the user has finished with one side of the cleaning sheet, the mop head may be flipped or inverted so that the reverse side of the cleaning sheet is presented to the floor.

As shown in FIGS. 2*b* and 4*b*, the cleaning sheet 122 extends from the leading edge(s) 114*a*, 114*b* of the mop head, where it is attached to the mop head, towards the trailing edge at the back end 116*a*. Preferably, the cleaning sheet is constructed so that the free portion (that is the portion not secured to the mop head) covers the cleaning support surface 102*a* entirely and extends to the trailing edge at the back end 116*a*. With the cleaning sheet interposed between the cleaning support surface 102*a* and the floor or surface to be cleaned (as shown in FIGS. 2*b* and 4*b*) and the first cleaning surface 102*a* of the cleaning sheet presented to the floor, the mop may be manipulated in any desired manner to clean the floor by collecting any encountered particulates, liquids or both. When the capacity of the first side of cleaning sheet is reached, the mop may be quickly and easily manipulated to invert the mop head (as sequentially shown in FIGS. 9*g*, 9*h*, 9*i*, and 9*j*) so that the second cleaning support surface 102*b* is directed towards the floor. Simultaneously with the inversion of the mop head, the cleaning sheet is reversed so that the cleaning sheet extends from the leading edges 114*a*, 114*b* towards the trailing edge at the back end 116*b* over the second cleaning support surface 102*b* with the opposite side of the cleaning sheet presented to the floor. It will be understood that this process eliminates the need for the user of the floor mop to have any contact with the cleaning sheet. The cleaning of the floor may be resumed until the cleaning capacity of the reverse side of the cleaning sheet 122 is reached. At this point, the mop head is opened and the cleaning sheet removed, with little or no contact by the user, and discarded.

Figure 7:
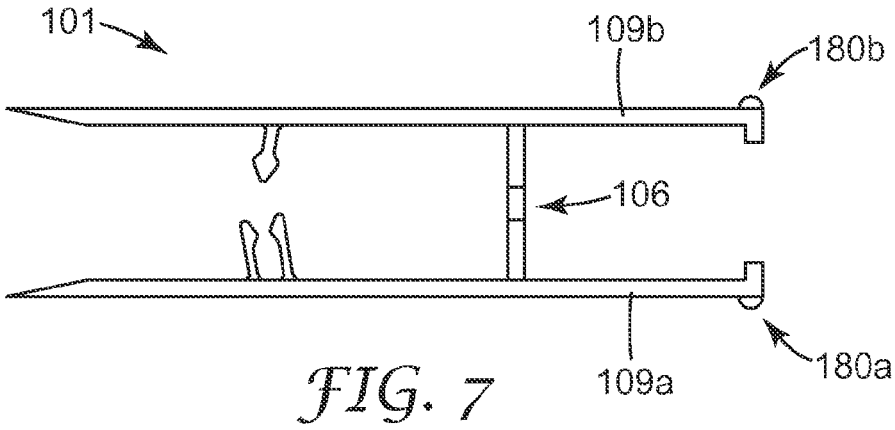
FIG. 7 is a side view of the mop head shown in FIG. 6*a* with ridges at the rear end.

The first and second cleaning support surfaces, 102*a* and 102*b*, respectively, may be modified, if desired. For instance, in one embodiment of the invention, a layer of a resilient material (as shown as layers 104*a*, 104*b* in FIGS. 2*a*, 2*b*, 4*a*, and 4*b*), such as, for example, a foamed layer polyurethane, styrene butadiene polymer, neoprene, or acrylonitrile polymer, may be applied to the first and second cleaning support surfaces 102*a*, 102*b* to resiliently support the cleaning sheet 122 while applied to a floor. This arrangement is particularly advantageous when a floor having an uneven surface, such a ceramic tile floor, is desired to be cleaned. Alternatively, the first and second cleaning support surfaces 102*a*, 102*b* may be adapted to frictionally grip the cleaning sheet. This may be accomplished by roughening the support surfaces such as with a knurled surface, or by the application of an adhesive, or such roughened surfaces may be integrally molded or embossed into the first and second cleaning support surfaces, or applied by a "flocking" process, as is known in the art. The support surface may also comprise one or more ridges 180*a*, 180*b*, as shown in FIG. 7, or other securing means at the back end of the mop head 101. Ridges 180*a*, 180*b* provide a torturous path for the material that prevents it from slipping out between the support surface and the floor when the mop head is moved in the reverse direction (i.e. toward the user). It also provides an additional amount of line friction that holds the free end of the mopping material down and prevents it from slipping past. Alternate securing methods include hook and loop, VELCRO, clamping mechanisms, adhesives, and the like.

It is another feature of the present invention that the proportion of the cleaning sheet that is actually applied to a floor for cleaning is maximized, and that the cleaning sheet is quickly and efficiently inverted to present the opposite cleaning surface of the cleaning sheet without requiring contact with the cleaning sheet by the user. Finally, the mop head may be opened and the used cleaning sheet removed from the mop head with minimal, or preferably no, contact by the user. A fresh cleaning sheet may be inserted and secured to the mop head as previously described. Further, the floor mop described herein may be utilized as part of a floor cleaning system in combination with an extended length of the cleaning sheet material. Typically, the extended length of the cleaning sheet material is provided in roll form. A suitable segment of the cleaning sheet material may be separated from the roll for use with the mop head.

Various modifications and alterations to the invention will become apparent to those skilled in the art without departing from the scope and spirit of this invention. It should be understood that the invention is not intended to be unduly limited by the specific embodiments and examples set forth herein, and that such embodiments and examples are presented merely to illustrate the invention, with the scope of the invention intended to be limited only by the claims attached hereto.

The complete disclosures of the patents, patent documents, and publications cited herein are hereby incorporated by reference in their entirety as if each were individually incorporated.

What is claimed is:

1. A dual-sided mop for cleaning a floor with a flexible cleaning sheet, the mop comprising:

(a) an elongate mop head having a generally A-shaped cross-section, the mop head including a first cleaning sheet support portion having a leading edge and a trailing edge, a front portion extending along the first cleaning sheet support portion leading edge, a second cleaning sheet support portion arranged to form a diverging angle with the first cleaning sheet support portion as the first and second cleaning sheet support portions extend away from the front portion, thereby defining a tapered channel between the first and second cleaning sheet support portions, and a cross bar portion extending from the first cleaning portion to the second cleaning portion; and (b) a securing mechanism arranged to allow the flexible cleaning sheet to be secured to the mop head;

(c) a connection member connected with the elongate cross bar portion of the mop head; and (d) a handle connected with the connection member.

2. The mop of claim 1, wherein the securing means is located adjacent or proximate to the leading edge of the mop head.

3. The mop of claim 1, wherein the securing means comprises a component of a hook and loop system.

4. The mop of claim 1, wherein the securing means comprises a clamping mechanism.

5. The mop of claim 1, wherein the securing means comprises an adhesive.

6. The mop of claim 1, wherein the first cleaning support lies in a first plane and the second cleaning support surface lies in a second plane that intersects the first plane thereby forming an angle between the planes of the cleaning support surfaces that is between about 70 and about 5 degrees.

7. The mop of claim 6, wherein the angle formed by the intersection of the planes of the support surfaces is between about 60 and about 10 degrees.

8. The mop of claim 6, wherein the angle formed by the intersection of the planes of the cleaning support surfaces is between about 45 and about 10 degrees.

9. The mop of claim 6, wherein the angle formed by the intersection of the planes of the cleaning support surfaces is between about 30 and about 10 degrees.

10. The mop of claim 1, wherein the mop head comprises a padding layer affixed to at least one of the cleaning support surfaces.

11. The mop of claim 1, wherein the cleaning sheet is a non-woven fabric constructed of polymeric fibers.

12. The mop of claim 1, wherein the cleaning sheet is constructed of a nonwoven web having fibers constructed of a material selected from the group consisting of polypropylene, polyethylene, polyester, nylon, and rayon.

13. The mop of claim 1, wherein the cleaning sheet is a blown microfiber web constructed of fibers comprising a blend of polypropylene and polyester.

14. A mop as defined in claim 1, wherein the mop head has a longitudinal axis, and wherein the connection member allows the handle to be rotationally pivoted about the axis, and further allows the handle to be pivoted along the axis.

15. A mop as defined in claim 14, wherein each of the first and second cleaning sheet support portions includes a cutout, and further wherein the connection member is movable between a first position wherein at least a portion of the connection member is arranged in one cutout, and a second position wherein at least a portion of the connection member is arranged in the other cutout.

* * * * *